United States Patent [19]

Terrell

[11] 4,345,646

[45] Aug. 24, 1982

[54] APPARATUS FOR CHEMICAL CUTTING

[75] Inventor: Jamie B. Terrell, Fort Worth, Tex.

[73] Assignee: Gearhart Industries, Inc., Fort Worth, Tex.

[21] Appl. No.: 78,472

[22] Filed: Sep. 24, 1979

Related U.S. Application Data

[63] Continuation of Ser. No. 877,085, Feb. 13, 1978, abandoned.

[51] Int. Cl.[3] ..... E21B 29/02

[52] U.S. Cl. ..... 166/55; 166/212; 166/297; 294/86.25; 24/263 DT

[58] Field of Search ..... 166/297, 55, 55.1, 63, 166/212, 120; 137/68 R; 220/89 R; 24/263 DT; 294/86.25

[56] References Cited

U.S. PATENT DOCUMENTS

| | | | |
|---|---|---|---|
| 1,439,244 | 12/1922 | Kimmel | 24/263 DT |
| 2,807,325 | 9/1957 | Webb | 166/63 |
| 2,918,125 | 12/1959 | Sweetman | 166/297 |
| 3,002,559 | 10/1961 | Hanes | 166/63 |
| 3,076,507 | 2/1963 | Sweetman | 166/297 |
| 3,147,809 | 9/1964 | Thomas | 166/98 |
| 3,658,206 | 4/1972 | Barbier | 220/89 A |
| 3,845,879 | 11/1974 | Dernbach et al. | 220/89 A |
| 4,059,150 | 11/1977 | Manderscheid | 166/120 |
| 4,125,161 | 11/1978 | Chammas | 166/297 |
| 4,158,389 | 6/1979 | Chammas et al. | 166/297 |

*Primary Examiner*—William F. Pate, III
*Attorney, Agent, or Firm*—William D. Jackson

[57] ABSTRACT

A cylindrical downhole chemical jet cutting tool including a generally cylindrical slip body having pipe gripping slips connected to a co-axially disposed expandable piston-cylinder biased toward a retracted position by a return spring; each slip includes a pivoting head pivotally retained by the slip body and biased toward a retracted from deployed position by a garter spring. Each slip defines at least two sets of gripping teeth having different gripping faces such that each gripping face becomes substantially parallel with the tool body axis as the slip becomes deployed a different respective distance from the tool. A slip expansion mandrel disposed within the slip array deploys the slips into gripping engagement as the piston-cylinder is actuated in response to application of fluid pressure. A chemical fluid cutting means including a fluid chamber defined within the tool body between two diaphragms can rupture from application of a designated differential fluid pressure. The fluid jet discharge part of the tool is adapted to direct fluid chemical from said tool body at high velocity.

12 Claims, 13 Drawing Figures

APPARATUS FOR CHEMICAL CUTTING

This application is a continuation of U.S. application Ser. No. 877,085, filed Feb. 13, 1978, now abandoned.

BACKGROUND OF THE INVENTION

This invention relates to a method of and apparatus for cutting tubing, and, more particularly, to a system employing a chemical cutting fluid of highly reactive incendiary character such that when brought into contact with tubing suspended in a wellbore, it will quickly burn therethrough. The term "cutting" is used herein as a generic term to include cutting, severing, perforating or slotting of tubing and other objects, as well as their complete disintegration. The objects referred to may be metal pipe or wellbore lining, including the earth formation surrounding or forming the wall of the wellbore or extraneous foreign objects such as lost drilling tools suspended therein. Prior apparatus for cutting tubing are commonly referred to simply as "tubing cutters". Such cutters are used, for example, in drilling operations where it is desired to detach a bullplug or other obstruction from the lower end of a tubing in a wellbore by severing the tubing above the bullplug. Tubing cutters are also used to salvage the tubing from an abandoned well or the part of the tubing above a stuck point.

There are various types of prior art tubing cutters, for example, shaped charged cutters and chemical cutters. There are problems associated with shaped charge cutters, however, because a tubing string into which the cutter can be lowered into the wellbore, often contains a pump seating nipple or landing nipple which forms a partial constriction in the tubing by reducing the size of the bore. This landing nipple may be located at a point intermediate the surface and the part of the tubing to be cut. In tubing cutters which are constructed to be partially recovered, the force generated by an explosion of a shaped charge in the tubing cutter causes parts of the cutter which are not disintegrated to become expanded or the end of the tubing to become flared. This expansion often times prevents the retrieval of the expanded part.

Chemical cutters have been shown to be very reliable while overcoming many of the aforesaid problems. They have been referred to as the simplest and most efficient tool for tubing cutting because the cut is made without flare, debris or damage to the adjacent string of tubing. One such prior art construction is shown and described in U.S. Pat. Nos. 2,918,125, issued Dec. 22, 1959 and 3,076,507, issued Feb. 5, 1963, both to William G. Sweetman. As set forth in the Sweetman Patents, the cutting fluids employed in accordance with that invention are fluids which are extremely active chemically and which when brought into contact with most oxidizable substances, react violently therewith generating extremely high temperatures sufficient to melt, cut or burn the adjacent tubing. Fluids such as halogenflourides, including cholorine tri-flouride as well as bromine tri-flouride, have been proven to be effective in tubing cutting.

There are several considerations which remain of major import in the utilization of such chemical cutters as set forth above. First, the secure anchoring, or downhole positioning of the cutter within the wellbore is a major consideration. The cutter must be fixedly positioned within the wellbore so as to make a uniform cut and to prevent the flaring or creation of debris within the wellbore to frustrate the attempt of an effective cutting operation. The rigidity of the anchoring and centralized positioning is thus of critical import. It is also necessary that the overall unit be functionally reliable, including sure ignition, positive fluid seals and environmental durability. For example, the insertion of the tool into the wellbore is coincident with immersion in those fluids normally present therein such as mud and sand. It is thus important that such substances do not adversely affect the operation of the subject tooling.

It would be an advantage therefore to provide a chemical tubing cutter which would overcome many of the problems of the prior art wherein the tubing cutter could be reliably and securely positioned within the wellbore for the cutting operation. It would be a further advantage to provide a single tubing cutter securable within known conduits of a different size while effecting the equivalent reliability. The method and apparatus of the present invention includes such a chemical tubing cutter wherein a multi-angulated slip assembly is utilized for circumferential engagement within tubing of different sizes. The tubing cutter of the present invention also provides a means for the reliable sealing, ignition and actuation of the incendiary elements therein for the proper maintenance and control thereof.

SUMMARY OF THE INVENTION

The invention relates to a chemical cutting method and apparatus including a tubular array containing means for centrally securing itself in a borehole and cutting the tubing therearound with an incendiary chemical fluid. More particularly, one aspect of the invention includes the incendiary chemical fluid of a halogen flouride disposed within a chemical module intermediate of a propellant and slip assembly module array and a discharge head assembly. The chemical is caused to be discharged in one or more high velocity streams, or jets, by applying to the body of the fluid a suitable compressible pressurizing medium of adequate magnitude. The pressurizing medium is a gas generated by the ignition and regular burning of one of various types of relatively slow burning propellants. By utilizing an electrical composition resistor as an ignition element, the ignition of the propellant may be more effectively and safely controlled to generate the gas at a predetermined time suitable for the particular application and the desired pressurizing force confined within the body of the cutting fluid. Furthermore, a rupturable ductile diaphragm is utilized to store said fluid wherein the diaphragm is selectively formed to rupture within a narrow range of differential fluid pressure to obtain buildup of the desired pressurizing force before the cutting fluid is activiated.

In another aspect of the invention, the slip assembly is provided in a cylindrically segmented array comprising a plurality of arcuate, tubing engaging elements assembled circumferentially about the slip assembly module substantially therearound. The array is adapted for the outward deployment thereof for engaging the maximum surface area of the tubing thereabout in predefined secured engagement patterns. Each slip element includes an elongated section of arcuate cross-sectional configuration having laterally extending tubing engagement edges constructed thereacross in generally parallel space relationship, longitudinally therealong. The lateral edges, or teeth of each slip are furthermore constructed in two discrete, longitudinal angulation configurations complimentally designed to engage two distinct diameters of tubing adjacent thereto, uniformly therealong, and centrally therein.

In yet another aspect, the slips are constructed and assembled whereby the longitudinal edges thereof in the undeployed mode generally circumferentially encompass the entire circumference of the underlying slip assembly region adjacent thereto for providing maximum utilization of surface area of the slip assembly for engaging the adjacent tubing therearound. In this manner, maximum strength and anchoring may be effected within the wellbore.

BRIEF DESCRIPTION OF THE DRAWINGS

For a more complete understanding of the present invention and for further objects and advantages thereof, reference may now be had to the following description taken in conjunction with the accompanying drawings, in which:

FIGS. 1 through 5, together, comprise a longitudinal, cross-sectional, side-elevational view of one embodiment of a chemical cutting apparatus constructed in accordance with the principles of the present invention, illustrating an array of propellant, chemical, slip and discharge head modules in end-to-end relation;

DETAILED DESCRIPTION

Figure 1:
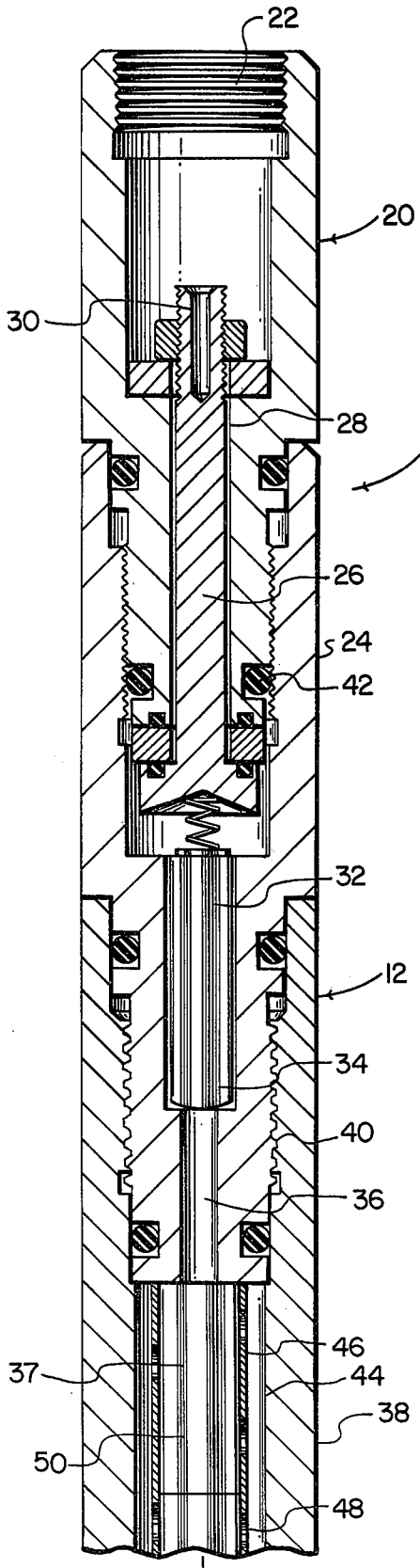

Referring first to FIGS. 1 through 5, there is shown a cutting tool designated generally by the number 10, which is inserted in a string of tubing (not shown) extending into a wellbore which may be lined with a metal casing (not shown). The cutting tool comprises in downwardly arranged succession, a propellant module assembly 12, a slip assembly 14, a chemical module assembly 16, and a discharge head assembly 18. These several modules, which are constructed of suitably strong material such as steel, are generally cylindrical and connected together in end-to-end coaxial relation. The modular array forms an elongated cylindrical tool 10 of substantially uniform exterior diameter, which is adapted for insertion into the tubing string on the end of a flexible cable, or the like (not shown). A head assembly 20, is connected to the upper end of the cutting tool 10 and includes a socket 22 of generally conventional form which connects the upper end of the tool 10 to the tool string or cable which is employed for lowering and raising said tool in the wellbore. The aforesaid tool string or cable, although not shown, includes means for transmitting an electric current from a conventional source about the wellbore to the tool 10 for the operation thereof.

Referring particularly now to FIG. 1 there is shown the propellant module assembly 12 disposed beneath and secured to the head assembly 20. Interconnecting the head assembly 20 and the propellant assembly 12 is a firing sub 24 containing an electrode 26 centrally therethrough insulated within a dielectric sleeve 28 therearound. A mating interconnection element, or plug 30 is constructed atop the electrode 26 for electrical communication with the surface above the borehole. Immediately beneath the electrode 26 and the firing sub 24, there depends a fuse assembly 32 including an explosive initiator element 34 of generally conventional design. The fuse assembly 32 being placed in electrical contact with the end of the electrode 26 provides means for igniting a controlled burning propellant disposed therebelow. A longitudinal passage 36 provides communication between the initiator cap 34 and a propellant chamber 37 formed in the propellant module assembly 12. The module 12 includes an outer sleeve 38 coupled to the fuse assembly via a threaded coupling 40. It should be noted that the various modules and subassemblies described herein, are conventionally coupled one to the other by threaded couplings and sealed with O-rings positioned therewithin. The threaded couplings and O-rings are not numbered but are clearly illustrated as is conventional in the art. The passage 36 terminates into a central bore 44 forming the chamber 37 and containing a propellant housing, or spacer 46 having a plurality of ports 48 formed along the length thereof. The propellant spacer 46 contains a plurality of power pellets 50 stacked therein or an integral propellant grain (not shown) and adapted for being ignited by the fuse assembly 32 disposed thereabove for the generation of a propellant gas.

Figure 2:
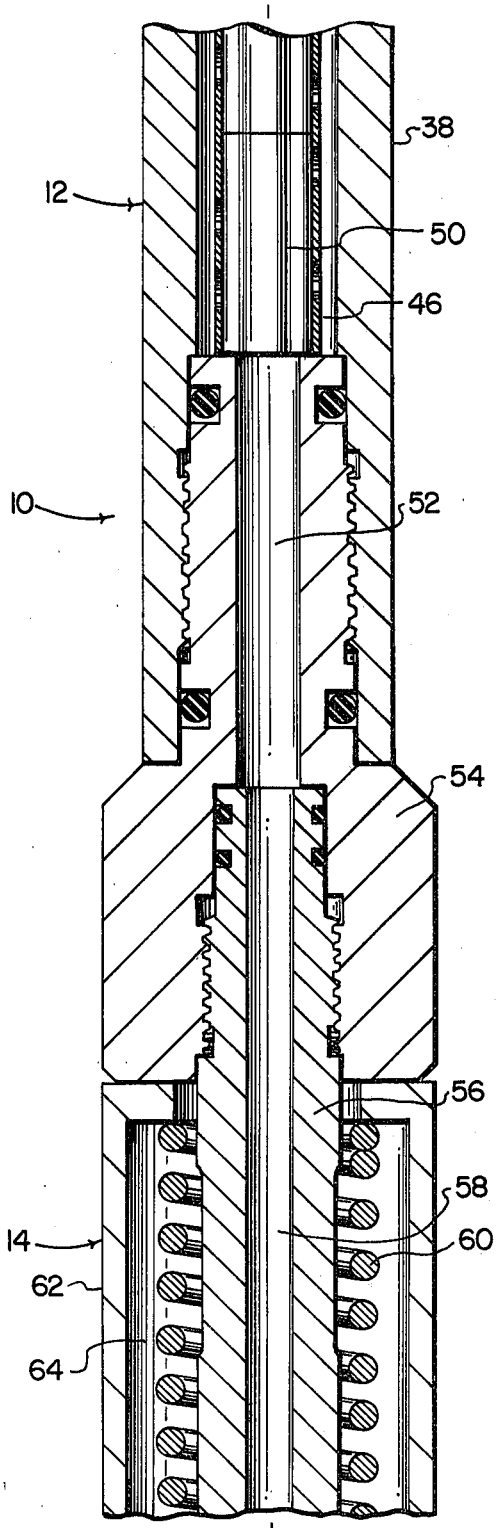

Referring now to FIG. 2, there is shown the lower part of the propellant assembly 12 and particularly the lower region of the power charge sleeve 46 containing the propellant therein. A suitable annular region may be provided around the propellant spacer 46 and within the tubular bore 44 of the propellant chamber 37 as shown for the generation of suitable pressurizing gases therein. The gases generated in the propellant assembly 12 are allowed to escape downwardly into the lower slip assembly 14 for actuation thereof via a tubular bore 52 constructed beneath the propellant chamber 37 in an upper region of the slip assembly 14 comprising an upper slip sub 54. The slip sub 54 is threadably coupled to a central slip shaft 56 depending therefrom. The slip shaft 56 comprises the structural center of the slip assembly 14 and includes a central bore 58 formed therethrough in abutting communication with the slip sub passage 52 for permitting the propellant gases to escape therethrough.

Referring now to the lower region of the tool 10 illustrated in FIG. 2, there is shown a cylindrical housing 62 with the slip shaft 56 received therein. A longitudinal compression spring 60 is provided within the slip assembly housing 62 within a central space 64 formed therein. The spring 60 circumferentially encompasses the slip shaft 56 longitudinally therealong longitudinally biasing the slip housing 62 upwardly against the upper slip sub 54.

Figure 3:
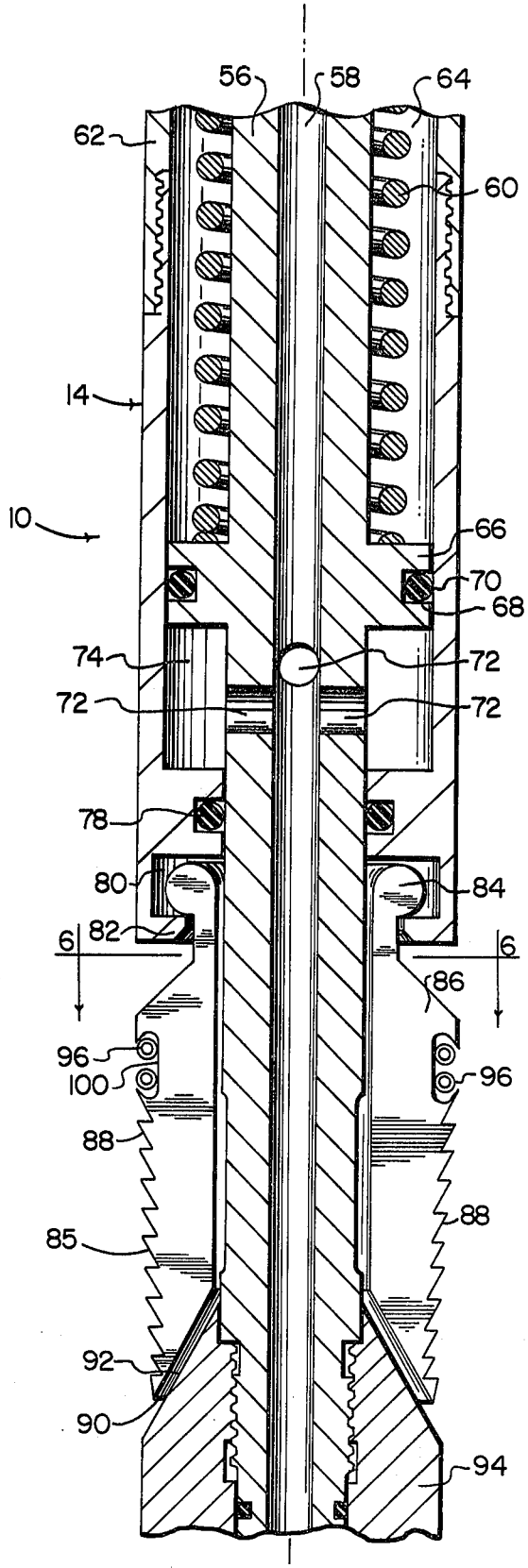
Figure 3:
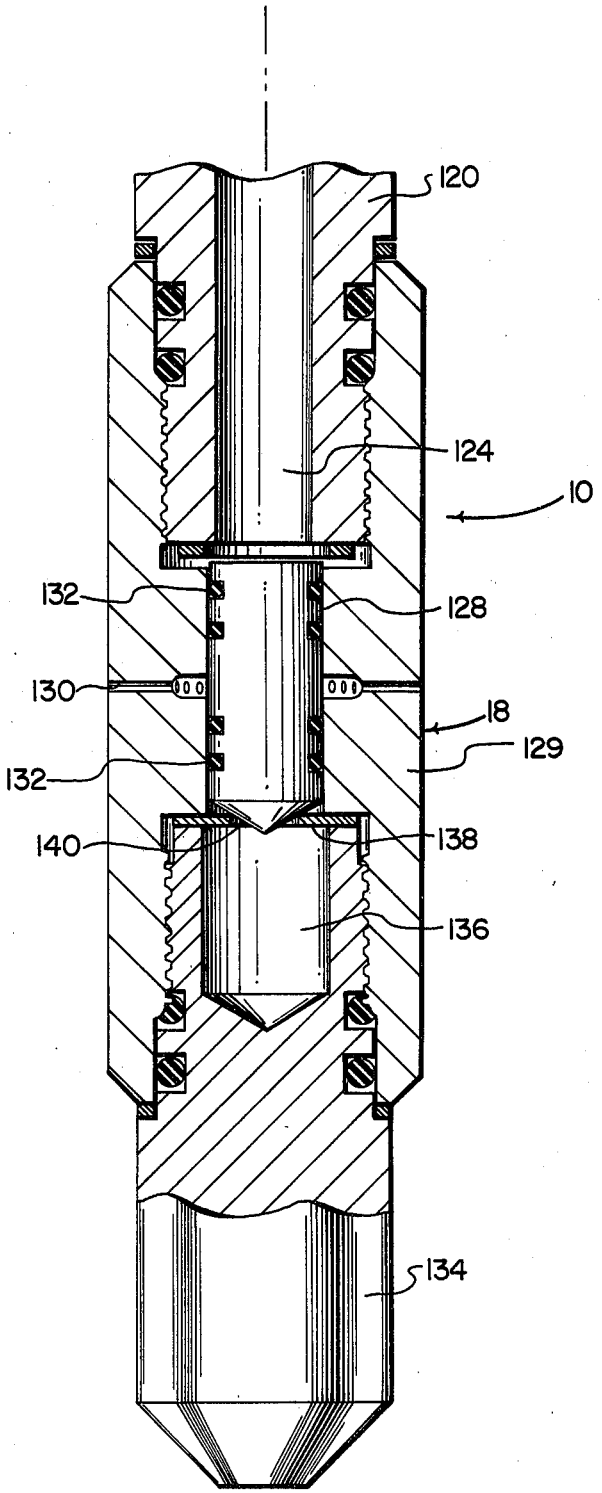

Referring now to FIG. 3, there is shown in the upper region thereof, the lower section of the slip assembly module 14 of the cutting tool 10. The slip shaft 58 may be seen to include a lower seating flange 66 for receiving the base of the spring 60 thereagainst. The flange 66 includes a circumferential slotted portion 68 containing an O-ring 70 therein for purposes of sealing the slip shaft 56 relative to the slip housing 62. A piston-cylinder configuration is thus constructed between the slip shaft 56 and slip assembly housing 62 respectively. Beneath the flange or piston 66 the central passage 58, extending through the slip shaft 56, is vented through venting ports 72 extending transversely therefrom and in communication with the passage 58 for venting a lower, annular space 74 beneath the flange 66. The slip housing 62 is constructed with a lower flange bulkhead 76 containing an O-ring 78 therewithin and around the slip shaft 56 for sealing the said housing thereagainst. In this manner, propellant gases escaping through the passage 58 will be vented into the annular space 74 for creating a pressure against the seating flange 66 and causing the slip assembly housing 62 to be driven downwardly along the slip shaft 56, against the biasing compression of the spring 60.

Referring now to the lower region of FIG. 3, there is shown the lower portion of the slip assembly housing 62 constructed with a partially open-ended annulus 80 constructed therein. A lower contrally aperture flange 82 forms the base portion of the annulus 80 and receives the upper head section 84 of an array 85 of gripping slips 86 pivotally seated therein about the slip shaft 56. The gripping slips 86 are constructed with a plurality of gripping teeth 88 on the outer surface thereof. The teeth 88 are adapted to engage and securely grip the wall of adjacent tubing as will be described in more detail below.

A plurality of slips are provided around the slip-shaft 56, each being constructed with a lower, internally tapered end 90. The end 90 of each slip 86 is adapted for abutting a complementally tapered frusto-conical mandrell 92 of a lower slip sub 94. The mandrel 92 functions as an incline plane for the slips 86 as they are driven downwardly with the slip assembly housing 62 in response to the generation of propellant gases within the propellant module 12. The downward movement of the slips 86 over the mandrel 92 causes the outward, angular deployment of the slips 86 for anchoring against the adjacent tubing. The slipshaft 56 may be seen to be structurally interconnected with the lower slip sub 94 through a threaded interconnection therebetween. Spring means 96 such as "garter springs" are provided around the slips 86 through a slotted portion 100 formed above the teeth 88. The spring means 96 may include any suitable elastic material or spring construction sufficient to lightly bias the slips 86 in the closed position shown.

Figure 4:
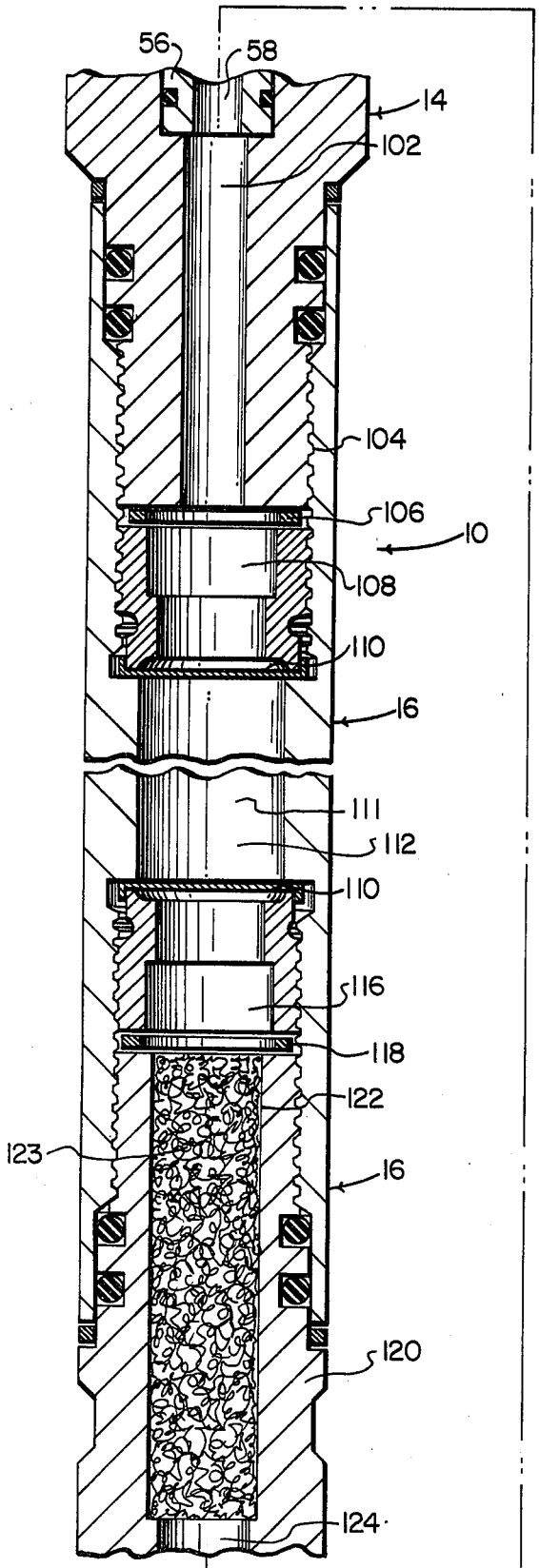

Referring now to FIG. 4, there is shown the lowermost portion of the slip assembly module 14 wherein the passage 58 of the slipshaft 56 communicates with a central bore 102 formed within the lower slip sub 94. The bore 102 comprises a passage for the egress of propellant gases from the passage 58 into the lower chemical module 16. The chemical module 16 is connected to the slip assembly module through a sealed interconnection 104, wherein means are constructed for sealably containing the select incendiary fluid stored in said chemical module. A gasket 106 is thus provided beneath the passage 102 atop a diaphragm retainer 108 abutting a rupture diaphragm 110. The diaphragm 110 is constructed with an area of reduced cross-section for rupturing at a predefined fluid pressure differential thereacross in a manner to completely open the flow passage therethrough as will be described in more detail below. The diaphragm 110 seals a fluid chamber 112 centrally bored within the chemical module 16 therein containing a selected incendiary fluid 111. The term incendiary chemical is used herein as referring to a highly reactive chemical which is particularly adapted for such downhole cutting operation. In particular, bromine tri-flouride has been found to be acceptable as an incendiary fluid for cutting operations in accordance with the teachings of the present invention. The aforesaid incendiary fluid is further contained within the chamber 112 by a lower rupture diaphragm 110. Likewise, a diaphragm retainer 116 and gasket 118 are provided therebeneath for the securement and sealing of the diaphragm 110 thereabove.

Compressed propellant gas generated in the propellant module 12 acts in a select manner and at a select pressure to cause the rupturing of the rupture diaphragm 110, forcing the incendiary fluid 111 within chamber 112 downwardly, rupturing the lower rupture disc 110 for passage into an igniter sub 120 partially housing within the chemical module assembly 16. The ignitor sub 120 is threadably coupled to the chemical module 16 and is constructed with a central chamber 122 containing steel wool 123 which may be coated with oil, or a similar product suitable for reaction with the respective incendiary fluid utilized. The steel wool 123 promotes a violent reaction when it contacts the downwardly egressing incendiary fluid 111 for the generation of further pressure and activity. A lower longitudinal passage 124 is constructed beneath the chamber 122 in communication therewith for the escape of the activated incendiary fluid 111.

Referring now to FIG. 5, there is shown the lower portion of the igniter sub 120 and the passage 124 extending therethrough and communicating with a discharge head piston 126 positioned within the discharge head module 18. The piston 126 is slidably mounted within an axial bore 126 constructed within the discharge head housing 129, which is formed with a plurality of radially extending venting ports or jets 130 extending outwardly of the central bore 128. The piston 126 is mounted within the bore 128 for downward movement and is suitably sealed therein with a plurality of smaller O-rings 132 secured therearound both above and below the discharge ports 130. Proper sealing of the piston is necessary to ensure the noncontamination of the tool 10 from well fluids during insertion within a wellbore.

The discharge head module 18 includes a lower bullnose 134 depending from and threadably coupled to the housing 129. The bullnose 134 forms the lower end of the tool 10. The bullnose is comprised of a generally cylindrical section having axial bore 136 constructed for receiving the piston 126 once said piston is driven downwardly by the pressure of the propellant and fluid generated thereabove.

The bullnose 134 is coupled to the discharge head housing 129 with a support washer 138 lodged therebetween. The support washer 138 is constructed with a central aperture 140 having a diameter small enough to retain the piston 126 thereabove. The washer 138 is also constructed of sufficiently thin material to deform and/or shear under preselected forces to permit the downward movement of the piston 126 under pressure of the escaping incendiary fluid 111. The downward movement of the piston 126 into the chamber 136 of the bullnose 134 opens the chamber 128 to the discharge ports 130, permitting the incendiary fluid 111 to jet therethrough. The discharge ports 130 are constructed in a radially extending pattern (not shown), which pattern is of conventional "overlap" design. An "overlap" pattern is one wherein fluid spray of adjacent discharge ports is contiguous upon the surface being cut so that the incendiary fluid discharged from said adjacent ports forms a substantially continuous cut pattern.

Figure 6:
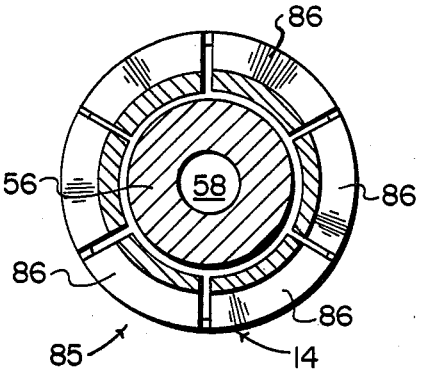
FIG. 6 is a top plan, cross-sectional view of the intermediate portion of the tubing cutter assembly of FIG. 3 taken along lines 6—6 thereof and illustrating the cylindrically segmented gripping slips assembled therearound.

Referring now to FIG. 6, there is shown a top plan view of the slip assembly 14 of FIG. 3 taken along lines 6—6 thereof and more clearly illustrating the positioning of the slips 86 therealong. In the tool 10 of the present embodiment, six slips 86 are provided to comprise a generally cylindrical array, segmented one from the other and constructed for outward deployment from the slip shaft 56. The term "cylindrically segmented" is hereinafter utilized in referring to the particular slip assembly array 85 of the present invention. The cylindrically segmented slip assembly 85 is constructed whereby inner surface area of the slips 86 substantially encompasses the slip shaft 56 therebeneath in a generally cylindrical, segmented housing configuration. It should be noted that the assembly of the slips 86 into the array 85 requires a "keyed" subassembly into the annulus 80 (FIG. 3). With the shaft 56 removed, the slips 86 are inserted into the annulus 80 and keyed together. The shaft 58 is then inserted to effect an assembly wherein the slips 86 are locked into place, one against the other. The outward deployment of the slips 86, with the head sections 84 pivoting within the annulus 90, then permits engagement of the adjacent tubing with maximum gripping effectiveness for secure anchoring thereagainst. Additionally, the segmented, cylindrical configuration of the slips array 86 ensures the centralization of the tubing cutter 10 within the wellbore since each slip deploys in a direction opposite to that of an opposing slip, an equivalent distance, automatically centralizing the position of the tool 10. Certain prior art constructions have heretofore utilized gripping slips having gripping teeth inscribed upon the outer surface thereof; however, such slips have not been provided in the segmented cylindrical array provided herein and in the gripping teeth angulation patterns facilitating multidiameter applications as discussed below.

Figure 7:
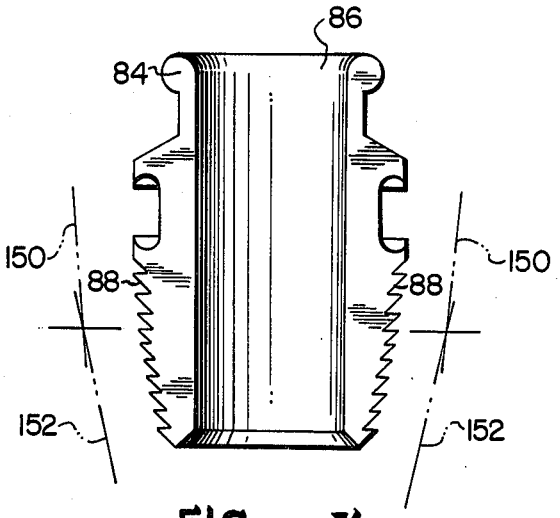
FIG. 7 is an enlarged, side-elevational view of an individual slip from the slip array of FIG. 3, illustrating the gripping teeth formed with two discrete angulation patterns.

Referring now to FIG. 7, there is shown a longitudinal, cross-sectional elevation of a slip 86 wherein the gripping teeth 88 formed upon the outer surface thereof may be seen in more detail. It should be noted that the gripping teeth 88 of the particular embodiment shown herein are provided in two discrete angulation patterns. These patterns are illustrated by the phantom lines 150 and 152 drawn on the surface of the gripping slip 86. The phantom line 150 illustrates a first angulation pattern for gripping teeth 88 formed on the upper half of the slip 86. The particular construction angle of the teeth 88 below line 150 is adapted for uniformly engaging an adjacent tubing wall of a certain diameter upon deployment of the subject slips. Each slip 86 engages the adjacent tubing with equivalent surface area engagement and pressure, due to the centralizing effect of the segmented cylindrical array 85 of the slip assembly 14. The angulation pattern defined by the phantom line 150 may be designed for a particular deployment angle equivalent to a particular tubing diameter.

Still referring to FIG. 7, phantom line 152 illustrates a second gripping teeth angulation pattern of less acute construction relative to the central axis of the slip shaft 56. In this manner, the slip 86 may be deployed at a greater angle than provided for by said first angulation pattern to uniformly engage a tubing wall of larger diameter.

Figure 8:
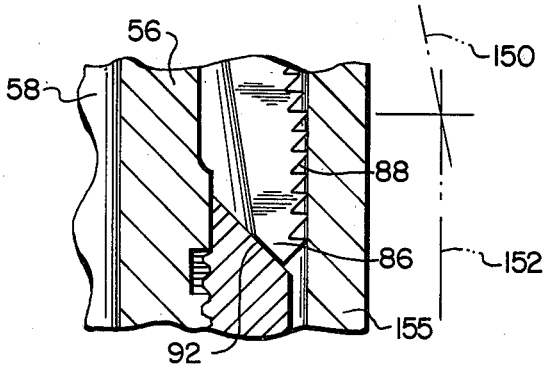
FIG. 8 is a fragmentary side-elevational, cross-sectional view of a slip assembly in an outwardly deployed configuration engaging the side wall of tubing in a borehole.

Referring now to FIG. 8, there is shown an example of the aforesaid first and second angulation patterns in engagement with a tubing wall and illustrated in exaggerated form. The upper gripping teeth 88 beneath the phantom line 150 are shown to be left unengaging the adjacent tubing 155 since the slip 86 shown therein is deployed at the select angle for anchoring tubing of a second larger diameter. It may be seen that if the tubing 155 were of a smaller select diameter, the upper section of the gripping teeth 88 would engage said tubing with the lower teeth, beneath phantom line 152 left unengaged. In this manner, a single cutting tool 10 may be utilized in boreholes of more than one diameter for cutting operations therein.

Figure 12:
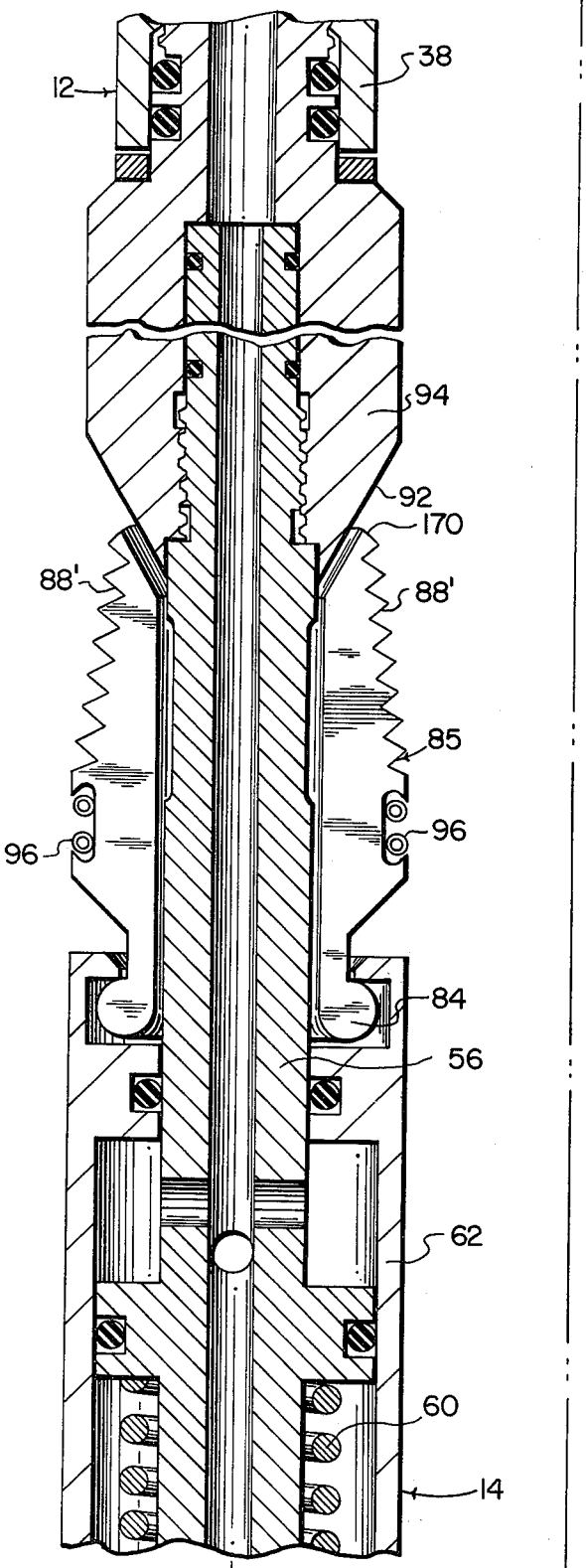
FIGS. 12 and 13 comprise a longitudinal, cross-sectional side-elevational view of an alternative embodiment of the slip assembly module of the present invention.
Figure 13:
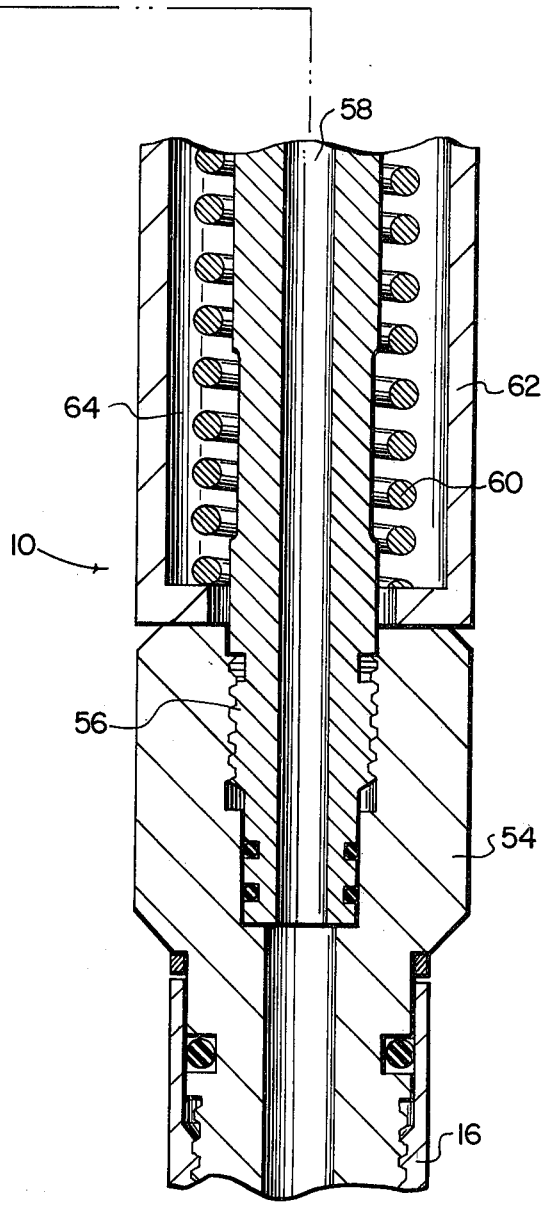

Referring now to FIGS. 12 and 13 there is shown a slightly different embodiment of slip assembly 14. As readily noted, in these drawings, slip assembly 14 is virtually the same construction as shown in FIGS. 2 and 3 except it is mounted in an inverted relationship top to bottom in the cutting tool 10. It may also be seen that the profile of slip 86 and in particular the gripping teeth 88 is slightly modified relative to the profile shown in FIG. 3. Accordingly, like elements of the slip assembly 14 as shown in FIGS. 2, 3, 7 and 8 bear the same numbers as the elements shown in FIGS. 12 and 13.

The operation of the slip assembly 14 as shown in FIGS. 2 and 3 is as follows: The gas pressure in space 72 causes the slips to engage the well tubing 155 in which tool 10 is positioned, and therein holding the tool 10 immobile until all the liquid reactive chemical is ejected through the venting ports, or jets, 130 and until the gas pressure is dissipated by egressing behind said liquid through said venting ports. As previously described, after the gas pressure has dissipated, the spring 60 is provided to retract the slip assembly 85 away from the walls of the tubing 155 into its initial retracted position. However, for some reason should spring 60 not allow the slip assembly 85 to detract, it would be difficult to disengage the slip 86 from the tubing 155. The only possible mechanical manipulation in such a position would be through the cable from which cutting tool 10 is suspended. The only feasible manner of disengagement in this instance is to impart a downward jarring for the tool 10. Wireline jars are available for this purpose but are expensive and a nuisance to use. It may thus be seen that in the embodiment of FIGS. 12 and 13, if spring 60 fails to disengage slip assembly 85, a tension applied by upward pull on the wireline will draw the conical mandrel 92 out from under the slips 86 quite readily for facilitating removal of the cutting tool 10 from tubing 155.

At times, the slip retaining means 100 may be damaged or destroyed by flow of the incendiary fluid past assembly 14. In the situation of FIGS. 2 and 3, such happening is of little consequence since the slips 86 tend to pivot inwardly when cutting tool 10 is pulled upwardly. However, the reverse is evident in the situation of FIGS. 12 and 13. To alleviate hangup problems in the tubing, slip 86 of this particular embodiment is provided with a bevel or chamfer 170 as shown. Bevel 170 allows each slip 86 to slide along the tubing wall in "sled" fashion if slip retaining means 100 becomes inoperable and fails to retract the slip. The gripping teeth 88' are also shown with a slight variation in the profile thereof. As shown in FIG. 7, the gripping teeth 88 are of a "buttress" profile slanting upwardly. In this alternate embodiment the teeth 88' are of equal sided of "V" shape with the included angle of the apex of the "V" being about 50°-90°. This slip tooth profile is considered superior in some respects in that it may be disengaged from embedment in the tubing more easily and also because it also remains firmly engaged by the piston 66 until the propellant gas pressure is dissipated through the jets 130 following evacuation of the incendiary chemical fluid. This slip also is of dual construction angle as shown by lines 150 and 152 of FIG. 7 shown in FIG. 8.

Figure 9:
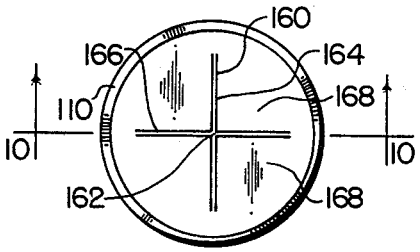
FIG. 9 is an enlarged top plan view of a rupture diaphragm of the chemical module of FIG. 4.

Referring now to FIG. 9, there is shown a top plan view of the rupture diaphragm 110. The diaphragm 110 includes an area of reduced cross-section 160 constructed by stamping, cutting or similar fabrication technique. The area 160 effectively ensures the rupture of the diaphragm at a closely preselected differential fluid pressure which is an important safety and reliability parameter. The pattern of the area of reduced cross-section 160 is shown herein as a cross having a central, intersectional area 162 formed at the intersection of grooves 164 and 166. The area 160 is shown in cross-section in FIG. 10 wherein it may be further seen that a differential fluid pressure applied across the diaphragm will induce the intersectional area 162 to first initiate rupture due to its relative structural weakness in tension. The rupture will then propagate along the grooves 164 and 166, radiating outwardly to isolate triangular sections 168 therebetween.

Figure 11:
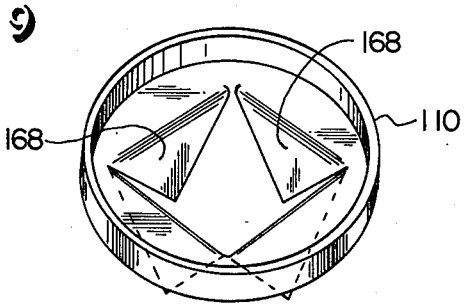
FIG. 11 is an enlarged perspective view of a rupture diaphragm illustrating the ruptured configuration thereof for providing a substantially full flow opening.

Referring now to FIG. 11, there is shown a perspective view of a ruptured ductile diaphragm 110 with sections 168 deformed downwardly, as against the side walls of the chamber 111. It may be seen that this ruptured configuration is the result of a fluid flow therethrough, either gas or liquid, which fluid flow is essentially unrestricted subsequent to said rupture. Since the diaphragm 110 ruptures in tension along the aforesaid lines 164 and 166, no fragments of the rupture diaphragm 110 are left in the tool 10 to interfere with fluid flow. This aspect is critical to maximum efficiency and safety of the tool 10 and is herein referred to as a substantially complete, unfragmented rupture.

An advantage of cutting tool 10, when incorporating diaphragm 110, and not known in the prior art, is the generally substantial lower ranges of gas pressure generated by propellent 50 to properly operate cutting tool 10. Such lower pressures of course increase the safe handling of the tool in or out of the wellbore. Also, as outlined below, such lower pressures are considered to enhance the cutting action of the reaction product of the incendiary fluid 111.

Figure 10:
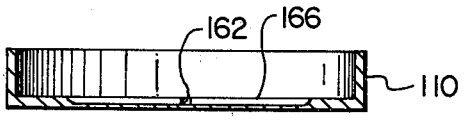
FIG. 10 is a side-elevational, cross-sectional view of the rupture diaphragm of FIG. 9, taken along lines 10—10 thereof.

The diaphragm 110, when constructed as described with reference to FIGS. 9 and 10, can be provided to rupture within a close pressure range, 100 psi for example, from about 500 to 4,000 psi differential pressure (and above though such higher pressures would never be needed in the tool of the present invention). The present cutting tool 10, which may be built in various sizes, is presently used in most instances with the rupture disc 110 having a rupture pressure in the range of about 1,000 to 2,500 psi differential pressure, though the pressures may go higher or lower at times depending on different factors.

Referring now to FIGS. 1-5, the complete interior of cutting tool 10 is at atmospheric pressure until the tool 10 is lowered to the selected position in well conduit 155 and the propellant 50 ignited. There is generally a small air space below the top of upper diaphragm 110 and the incendiary liquid 111. The cavity 122 also contains some air. As an illustrative description, when the propellant 50 is ignited it continues to burn and produce gas until expended. The amount of propellant is provided in sufficient quantity to eventually reach a pressure sufficiently higher than the pressure inside tubing 155 to produce a good jetting action of the chemical reaction product through ports 130 properly against the walls of tubing 155, though the action of the chemical reaction product is the action that cuts the tubing without relying on the force of the fluid jet against the tubing wall.

Assuming that both the diaphragms 110 are provided to rupture at 1,500 psi differential pressure, the gas pressure generated by propellant 50 ruptures first the top diaphragm then the lower diaphragm 110 in very close succession, forcing the incendiary chemical 111 into chamber 122 with the reaction product such as the steel wool given as an example. The reaction may produce additional gas pressure, depending on the reactive components provided.

The support washer 139 may be provided of thickness to permit piston 126 to clear ports 130 immediately or of greater thickness to provide time for creating more or less pressure and reaction product before deforming or shearing to allow the reaction product to be jetted by the gas pressure through ports 130 against the walls of tubing 155. When the ports 130 are cleared for passage of the reaction product, the pressure of the compressible gas within tool 10 should then be adequately greater than the pressure within tubing 155 to immediately permit the good jetting action previously described. Though the real pressure within the tool 10 may become quite high during the getting of all the reaction product, the differential pressure between the interior and exterior of tool 10 need not be greater than necessary to produce the good jetting action as previously described. Thus, if the tool were inadvertantly activated at the earth's surface or in a dry hole, the differential pressure utilized for the jetting predictably would remain relatively low and more safe and consistent.

DESCRIPTION OF OPERATION

The apparatus of the present invention is operated in the following manner: The various modules of the tool 10 are charged with the above-described propellant, ignition, and incendiary chemical and assembled as illustrated in FIGS. 1 through 5. The tool 10 is then connected to a suspension cable and lowered into the tubing 155 to the point at which the cut is to be made. The tool 10 is next firmly anchored to the tubing wall by the controlled ignition of the propellant assembly 12. The propellant assembly is activated by the detonation of the firing sub 24 and fuse 32 through electrical communication from the surface of the borehole. The electric current may be provided from any suitable and conventional source (not shown). The ignition of the fuse 32 then ignites the propellant whereby gas pressure is created. The gas egresses downwardly into the slip assembly 14 and into the slip assembly housing 62. The slip housing 62 moves downwardly along the slip shaft 56 pushing the slips 86 against the mandrel 92 causing the slips to deploy outwardly into the adjacent tubing 155. The tool 10 is now securely anchored in a centralized configuration within the borehole.

The propellant gas within the now anchored tool 10 continues to build up from the gases produced by the propellant sub 12 until the upper diaphragm 110 atop the chemical module 111 is ruptured. The rupture of the upper diaphragm 110 causes the incendiary fluid contained therein to move downwardly under pressure rupturing the lower diaphragm 110 and egressing into the ignitor sub 120. In the ignitor sub 120 the incendiary fluid engages the ignitor hair such as steel wool therebelow. The incendiary fluid is activated in the ignitor hair, with a resulting build-up in gas pressure which will be exerted against the end of the piston 126, forcing it downwardly into the cylinder portion 136 to uncover the inner ends of the discharge ports 130. The preignited incendiary fluid will thus discharge from the discharge ports 130 at tremendous pressures and velocity as well as at high temperatures. The discharging fluid will then strike the pipe wall or tubing 155 opposite the ends of the passages, wherein the fluid will react with the pipe wall which will be burned or dissolved effecting the desired cutting result.

It may be seen that the pressure of the propellant gases causing the slips 86 to deploy outwardly into the tubing 155 has securely lodged the tool 10 within the wellbore. It may also be seen that the tool 10 will remain lodged within the wellbore unless the slips 86 are suitably retracted. For this reason, when the propellant gas pressure is substantially vented the biasing force of the spring 60 returns the slip housing to its upright position whereby the slips 86 are separated from around the mandrel 90. In the retracted position the slips 86 are automatically retracted from the side walls of the tubing 155 under the tension of the garter spring 96 disposed therearound. Once the slips 86 assume their retracted position the tool 10 may be removed from the borehole by pulling it upwardly. Likewise it may be recharged for subsequent usage.

In the alternative structural embodiment of the tool 10 shown in FIGS. 12 and 13, it may be seen that the identical procedural steps are required to activate the tool 10 to effect cutting in the borehole. However, the specific operation of the slip assembly 14 is effected by an upward driving of the slips against the mandrel 92 in that the slip assembly module 14 has been inverted. In all other respects, the operation of the tool 10 is the same as described above, with the exception that during removal should slip retraction become a problem, an upward tugging on the supporting cable will permit the mandrel 92 to be pulled from beneath the base of the slips 86 to permit said slips to return to their initial position. In like manner, the garter spring 96 then serves as a biasing element for returning the slips 86 to their initial position. Should the slips 86 yet fail to retract for any reason, the tool 10 may still be removed from the borehole as set forth above. More particularly, the chamfer 170 of the slip structure shown in FIG. 12 permits the slip to be "dragged" upwardly in a "sled" fashion. This design aspect may thus be seen to add another utility dimension to the particular configuration of the cylindrically segmented slip array set forth in the present invention.

It is therefore believed that the operation and construction of the above-described invention will be apparent from the foregoing description. While the method and apparatus for chemical cutting in a borehole shown and described has been characterized as being preferred, it will be obvious that various changes and modifications may be made without departing from the spirit and the scope of the invention as defined in the following claims.

I claim:

1. A downhole chemical fluid jet cutting tool adapted to be suspended from an electrical wireline comprising in combination:

(a) an elongated generally cylindrical tool body;

(b) a generally cylindrical slip body means forming part of said tool body and comprising a pipe gripping slips array connected into a fluid pressure responsive co-axially disposed expandable piston-cylinder means;

(c) said piston-cylinder means being biased toward a retracted position by elastic return means;

(d) each slip of said slips including a head at a first end being retained by said slip body and being biased toward a retracted position from a deployed position by positive retraction means;

(e) said piston-cylinder means including a slip expansion mandrel means disposed within said slip array to deploy said slips into gripping engagement as said piston-cylinder is actuated against said elastic return means in response to application of fluid pressure;

(f) a chemical fluid cutting means forming part of said tool body including a fluid chamber adapted to contain a fluid chemical defined within said tool body between two diaphragm means provided to rupture from application of a designated differential fluid pressure; and (g) a fluid jet discharge means formed in said tool body and adapted to direct fluid chemical from said tool body in selected direction and at high velocity.

2. The cutting tool of claim 1 wherein each of said slips defines at least two sets of gripping teeth having different gripping faces defined by said gripping teeth such that each gripping face becomes substantially parallel with the axis of said tool body as each of said slips becomes deployed a different respective distance from said tool body.

3. The cutting tool of claim 1 wherein said tool body is provided with fluid pressure generating means adapted to contain and ignite a gas generating propellant for generating fluid pressure to deploy said slips into pipe gripping position, to rupture said diaphragms, to release said fluid chemical, and to force said fluid chemical from said fluid jet discharge means.

4. The cutting tool of claim 1 wherein each of said diaphragms is formed with a cross-sectional rupture area defined along at least one line extending across said diaphragm and provided to rupture responsive to a closely designated differential fluid pressure applied across said diaphragm.

5. The apparatus of claim 1 wherein said cutting tool includes an ignitor means disposed to cause an incendiary reaction of chemical fluids passing from said fluid chamber to said jet cutting means.

6. The cutting tool of claim 1 wherein the cross-sectional area of each of said rupture diaphragms is provided to be ruptured by a fluid pressure differential closely designated within the range of 500 psi and 3,500 psi to cause said cutting tool to be operative in a safe and predictable fashion.

7. The cutting tool of claim 3, wherein each of said slips defines at least two sets of gripping teeth having different gripping faces defined by said gripping teeth such that each gripping face becomes substantially parallel with the axis of said tool body as each of said slips becomes deployed a different respective distance from said tool body.

8. The cutting tool of claim 7 wherein each of said diaphragms is formed with a cross-sectional rupture area defined along at least one line extending across said diaphragm and provided to rupture responsive to a closely designated differential fluid pressure applied across said diaphragm.

9. The cutting tool of claim 8 wherein the cross-sectional area of each of said rupture diaphragms is provided to be ruptured by a fluid pressure differential closely designated within the range of 500 psi and 3,500 psi to cause said cutting tool to be operative in a predictable manner.

10. The apparatus of claim 9 wherein said cutting tool includes an ignitor means disposed to cause an incendiary reaction of chemical fluids passing from said fluid chamber to said jet cutting means.

11. The cutting tool combination of claim 1 wherein the slips of said array each have at least two gripping teeth angulation patterns such that: (a) the outer extremities of first teeth of a first angulation pattern define a first line disposed in a plane related to the axis of said tool such that said first line defines a first acute angle with said tool axis when said first teeth are not deployed and such that said first line is disposed substantially parallel to said tool axis when said first teeth are deployed a first distance from said tool axis; and (b) the outer extremities of second teeth of a second angulation pattern define a second line disposed in a plane related to said tool axis such that said second line defines a second acute angle with said tool axis when said first teeth are not deployed, said second acute angle being different from said first acute angle, and such that said second line is disposed substantially parallel to said tool axis when said second teeth are deployed a second distance from said tool axis, said second distance being different from said first distance.

12. An elongated generally cylindrical downhole tool comprising in combination:

(a) anchoring means for releasably anchoring the tool in a centralized position against the wall of a pipe in a well;

(b) said anchoring means including an array of gripping slips that are pivotally mounted at one end to a first structural element;

(c) said array having a central axis that is coaxial with the axis of said tool;

(d) said gripping slips having internally tapering other end portions for longitudinal movement upon and slidable mating engagement with a frustoconical mandrel for the outward depolyment of said slips;

(e) said gripping slips having an arcuate cross-sectional configuration so that the interior of said array is generally cylindrical when said slips are not deployed; and (f) said gripping slips of said array each have at least two gripping teeth angulation patterns such that:

(1) the outer extremities of first teeth of a first angulation pattern define a first line disposed in a plane related to said tool axis such that said first line defines a first acute angle with said tool axis when said first teeth are not deployed and such that said first line is disposed substantially parallel to said tool axis when said first teeth are deployed a first distance from said tool axis; and (2) the outer extremities of second teeth of a second angulation pattern define a second line disposed in a plane related to said tool axis such that said second line defines a second acute angle with said tool axis when said first teeth are not deployed, said second acute angle being different from said first acute angle, and such that said second line is disposed substantially parallel to said tool axis when said second teeth are deployed a second distance from said tool axis, said second distance being different from said first distance.

* * * * *